United States Patent [19]

Opfer

[11] 4,237,357

[45] Dec. 2, 1980

[54] OPERATING MECHANISM FOR A HIGH-VOLTAGE SWITCH

[75] Inventor: John C. Opfer, Deerfield, Ill.

[73] Assignee: S & C Electric Company, Chicago, Ill.

[21] Appl. No.: 26,867

[22] Filed: Apr. 4, 1979

[51] Int. Cl.[3] ..... H01H 3/30

[52] U.S. Cl. ..... 200/153 SC; 200/318; 335/76

[58] Field of Search ..... 335/74, 75, 76, 77; 200/153 SC, 153 V, 153.6, 153 R, 67 PK, 318, 320, 323, 325, 288

[56] References Cited

U.S. PATENT DOCUMENTS

| | | | |
|---|---|---|---|
| 2,769,874 | 11/1956 | Coggeshall et al. | 200/318 |
| 2,822,445 | 2/1958 | Schindler et al. | 335/74 |
| 3,202,897 | 8/1965 | Gallen et al. | 335/76 |
| 3,522,401 | 8/1970 | Stene | 200/153 SC |
| 3,789,172 | 1/1974 | Cole | 335/76 |
| 3,980,977 | 9/1976 | Evans | 335/74 |

*Primary Examiner*—John W. Shepperd
*Attorney, Agent, or Firm*—John D. Kaufmann

[57] ABSTRACT

An improved operator for a high-voltage switch. Prior art operators have a drive member connected to the switch for operation thereof. Immediately after the switch is opened, the drive member is held by a first latch and a spring is automatically charged to bias the drive member to close the switch. When the first latch selectively releases the drive member, it moves to close the switch. Immediately thereafter, the drive member is again held by a second latch and the spring is automatically charged to bias the drive member to open the switch. When the second latch releases the drive member, it now moves to open the switch. In prior art operators the latches sometimes fail to immediately hold the drive member rendering ineffective attempts to recharge the spring. A control system is provided which permits charging of the spring only if the respective latches hold the drive member following a switch operation. The system also reinitiates the prior charging of the spring if, after the drive member moves to operate the switch, the respective latches do not hold the drive member. Reinitiation of the spring charging holds the drive member until the latches succeed in holding it.

8 Claims, 11 Drawing Figures

OPERATING MECHANISM FOR A HIGH-VOLTAGE SWITCH

BACKGROUND OF THE INVENTION

1. Field of the Invention

The present invention relates to an improved operating mechanism for a high-voltage switch, and more particularly, to an improved high-voltage switch operating mechanism which has a spring automatically chargeable by an electrical motor to perform both switch-opening and switch-closing operations.

2. Description of the Prior Art

The present invention is an improvement of commonly assigned U.S. Patent Application Ser. No. 911,123, filed May 31, 1978 in the name of Evans and Rogers and incorporated by reference hereinto. The mechanism described in the '123 application is in turn an improvement over that disclosed in commonly assigned U.S. Pat. Nos. 3,980,977 and 3,563,102. Other aspects of the mechanism of the '123 application are disclosed in the following commonly assigned U.S. Patent Applications: Ser. Nos. 911,122 and 911,124, both filed May 31, 1978; and Ser. No. 922,326, filed July 16, 1978.

In the switch operating mechanisms of the '123 application and the '977 patent, there is included a first movable member which may take the form of a rotatable disk-like lever. A second movable member which may also take the form of a rotatable disk-like lever is connectable to the switch for operation thereof as the second members moves. A stored energy facility, such as a spiral spring, is connected between the members so that movement of the first member in a first direction, while the second member is held in a second position by a first latch, stores energy in the stored energy facility. The energy thus stored biases the second member for movement in a first direction from the second position to a first position. Movement of the first member in a second direction, while the second member is held in the first position by a second latch, stores energy in the stored energy facility. The energy thus stored biases the second member for movement in a second direction from the first to the second position. The first member is selectively movable by a motive power source, such as an electric motor, via a gear train or the like. The '123 application also contemplates manual movement of the first member; such manual movement is not involved in the present invention.

A third latch holds the first member after it has moved a predetermined amount in the first direction. A first release mechanism may selectively release the first latch anytime after the first lever is held by the third latch. Release of the first latch frees the second member for movement, under the action of the stored energy, to the first position in the first direction to effect a switch operation, either opening or closing. A first disengaging mechanism, carried by the second member, disengages the third latch following movement of the second member to the first position. Disengagement of the third latch frees the first member for subsequent movement in the second direction to re-store energy.

A fourth latch holds the first member after a predetermined amount of movement in the second direction. A second release mechanism may selectively release the second latch anytime after the first member is held by the fourth latch. Release of the second latch permits the stored energy to move the second member in the second direction to the second position. A second disengaging mechanism, carried by the second member, disengages the fourth latch following movement of the second member to the second position. Disengagement of the fourth latch frees the first member for subsequent movement in the first direction to again re-store energy.

The first and second latches are capable of holding the second member only after full movement thereof to the second and first positions in the second and first directions, respectively. That is, the first latch holds the second member only after it has fully moved to the second position, while the second latch holds the second member only after its full movement to the first position.

The intent of the '123 application and the '977 patent is that, following energy storage due to movement of the first member followed by the holding of the first member by either the third or fourth latch, the first latch or the second latch (depending upon which is holding the second member) may be selectively released to permit the second member to move and thereby effect switch operation. Selective release of the first and second latches is dictated by electrical conditions in a circuit to which the switch is connected or by any other requirement to switch the circuit. Energy may be stored, however, only if following the previous switch operation either the first or second latch properly holds the second member, for, only if the second member is held, will subsequent movement of the first member be effective to store energy. The mechanisms of the '123 application and the '977 patent involve the storage of large amounts of energy and rapid movement of the second member. It has been found that these factors can lead to the first or second latches bouncing, or otherwise improperly operating, so as to not immediately hold the second member following its movement to a position where the first or second latches should be effective to hold it. Also, the speed of operation of the first and second latches has been found to be somewhat slow relative to the high speed of other elements of the mechanism and they have been found to be not always able to latch the second member immediately upon its movement to positions where it should be latched thereby.

The mechanisms of the '123 application and the '977 patent are designed to immediately re-store energy in the spring immediately following a switch operation. However, if immediately following movement of the second member, the first or second latches do not hold the second member, movement of the first member is ineffective to re-store energy. Further, it has been found that the second member may not always fully move following release of the first or second latches. This prevents the member from being held by the second or first latches, prevents the disengaging mechanisms from disengaging the third and fourth latches to free the first member for movement to re-store energy for a subsequent switch operation, and leads to (or may be caused by) the switch being not fully operated.

The present invention, therefore, is intended to improve the mechanisms of the '123 application and the '977 patent by obviating or eliminating improper operation thereof, as discussed above.

SUMMARY OF THE INVENTION

The improved switch-operating mechanism of the present invention may include the elements of the operating mechanisms of the '123 application or the '977 patent, discussed above.

A first sensor energizes the motive source to move the first member in the first direction if the second member is held in its second position by the first latch. As noted above, only if the second member is held in the second position by the first latch is movement of the first member in the first direction effective to store energy. The first sensor may also energize the motive source if, at the same time the second member is held in its second position, the third latch is not holding the first member. The first sensor de-energizes the motive source when the third latch holds the first member, which indicates that full energy is stored for moving the second member in the first direction. Following energy storage, the first latch may be selectively released to permit movement of the second member in the first direction thereby attempting to effect a switch operation.

Following such attempted switch operation, a second sensor re-energizes the motive source to again move the first member in the first direction if the second member has moved near or to its first position, but for some reason is not held thereat by the second latch. Such re-energization of the motive source again moves the first member in the first direction tending to store energy, which has the effect of maintaining the second member in, or moving it to, the first position until the second latch holds the second member. The second sensor de-energizes the motive source in response to the second latch holding the second member in the first position.

A third sensor energizes the motive source to move the first member in the second direction if the second member is held in its first position by the second latch. The third sensor may also energize the motive source if, at the same time the second member is held in its first position, the fourth latch is not holding the first member. The third sensor de-energizes the motive source when the fourth latch holds the first member. Again, only if the second member is held in its first position by the second latch is movement of the first member effective to store energy. Following energy storage, the second latch may be selectively released to permit movement of the second member in the second direction thereby attempting to effect a switch operation.

Following such attempted operation, a fourth sensor reenergizes the motive source to again move the first member in the second direction if the second member moves to or near the second position, but for some reason is not held thereat by the first latch. This has the effect of maintaining the second in, or moving it to, the second position until the first latch holds it. The fourth sensor de-energizes the motive source in response to the first latch holding the first member in the second position.

The present invention therefore obviates improper operation of the mechanisms of the '123 application and the '977 patent, specifically, failure of the second member to fully move following release of the first or second latch.

DETAILED DESCRIPTION

Figure 1:
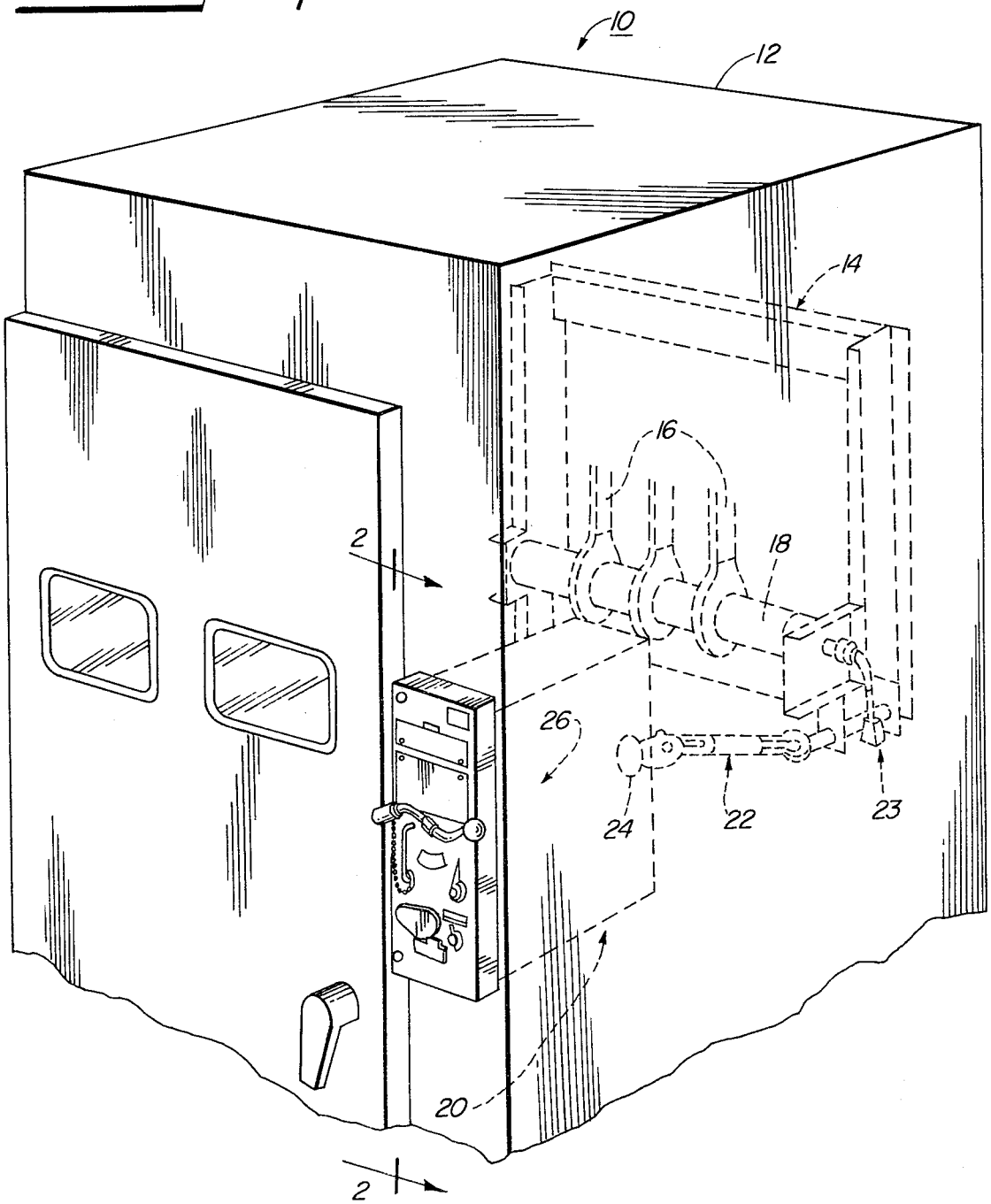
FIG. 1 is a perspective view of high-voltage switchgear utilizing the operating mechanism of the present invention to operate a switch thereof.

Referring first to FIG. 1, there is shown high-voltage switchgear 10 according to the principles of the present invention. The switchgear 10 includes a metal enclosure 12 which contains a high-voltage switch, only generally indicated at 14. The high-voltage switch 14 may take any form which is convenient, but preferably takes the form depicted in commonly assigned U.S. Pat. Nos. 3,549,840 and 3,676,629 and U.S. Patent Application, Ser. No. 956,463, filed Oct. 30, 1978. The switch 14 may include a plurality of switch blades 16 commonly rotatable on a common insulative strut 18 into and out of engagement with stationary contacts (not shown). Also contained within the enclosure 12 is a switch operator 20 pursuant to the principles of the present invention, and as disclosed in the '123 application. The switch operator 20 may, also as disclosed in the abovereferred-to '122 and '124 applications, be at least partially removable from the enclosure 12 for maintenance, adjustment and repair purposes; the operator 20 may include some or all of the other features of these applications as well as of the '326 application. The switch operator 20 is connected to the switch 14 by a drive shaft, generally indicated at 22, and a motion translator, generally indicated at 23. The drive shaft 22 and the translator 23 are effective to convert operation of the operator 20 into rotation of the switch blades 16. The drive shaft 22 and the translator 23 preferably constitute a rotary-to-rotary coupler between the operator 20 and the switch 14.

Figure 2:
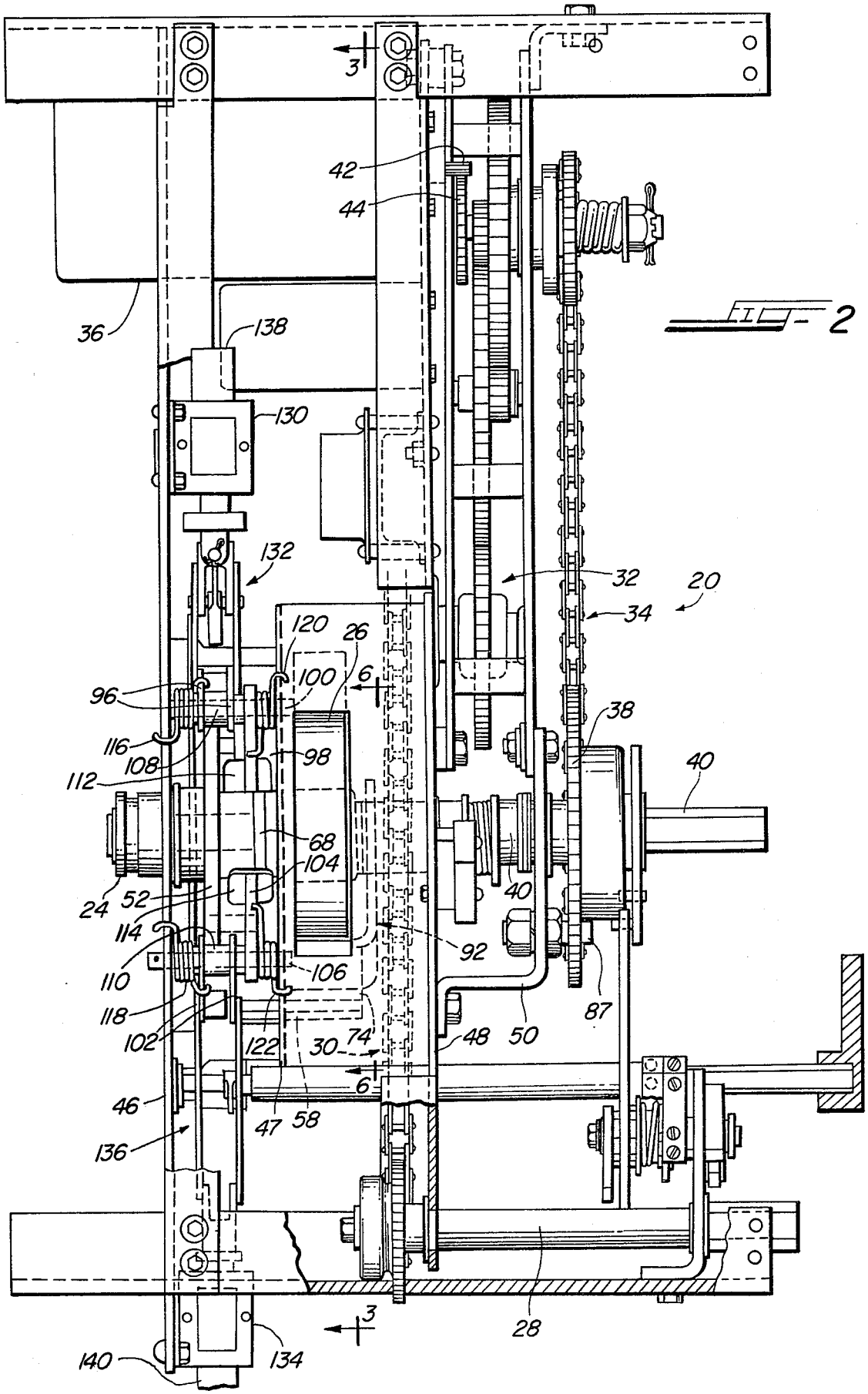
FIG. 2 is a side elevational view of the switch operating mechanism according to the present invention taken generally along line 2—2 of FIG. 1.

Referring to FIGS. 1 and 2, and as more fully explained in the '123 application, the switch blades 16 of the switch 14 in one position engage the stationary contacts (not shown) to complete a circuit (switch closed) and in another position are disengaged from the stationary contacts (not shown) to open the circuit (switch open). A rotatable output hub 24 of the operator 20 is appropriately coupled to the drive shaft 22. As viewed in FIGS. 1 and 3, counterclockwise rotation of the output hub 24 closes the switch 14 and clockwise rotation of the hub 24 opens the switch 14. The output hub 24 is selectively rotated by energy stored in a spiral spring 26.

Energy may be stored in the spring 26 in one of two ways. A hand-crank shaft 28 may be manually rotated to charge the spring 26 via a chain 30, a gear train assembly 32 and another chain 34. Also, the spring 26 may be automatically charged by operation of a motor 36, or other motive power source, via the gear train assembly 32 and the chain 34. In either case, movement of the chain 34 rotates a meshing sprocket 38 which effects rotation of a main shaft 40 on which the sprocket 38 is fixed, to charge the spring 26. The exact manner of charging the spring 26 by rotation of the main shaft 40 is described briefly below and in more detail in the '123 application. It should be noted that the present invention does not concern manual charging of the spring 26, or other manual operation of the switch operator 20, including manual rotation of the hand crank shaft 28. The present invention specifically relates to automatic operation of the switch operator 20 and charging of the spring 26 by the motor 36.

Operation of the motor 36 rotates an output gear 42 thereof. Rotation of the output gear 42 rotates a spur gear 44 which is included in the geartrain assembly 32. As more fully described in the '123 application, rotation of the motor 36 may be in either direction to rotate the main shaft 40 in either direction. Rotation of the spur gear 44 ultimately moves the chain 34 to rotate the sprocket 38 and the main shaft 40 either clockwise or counterclockwise.

Figure 5:
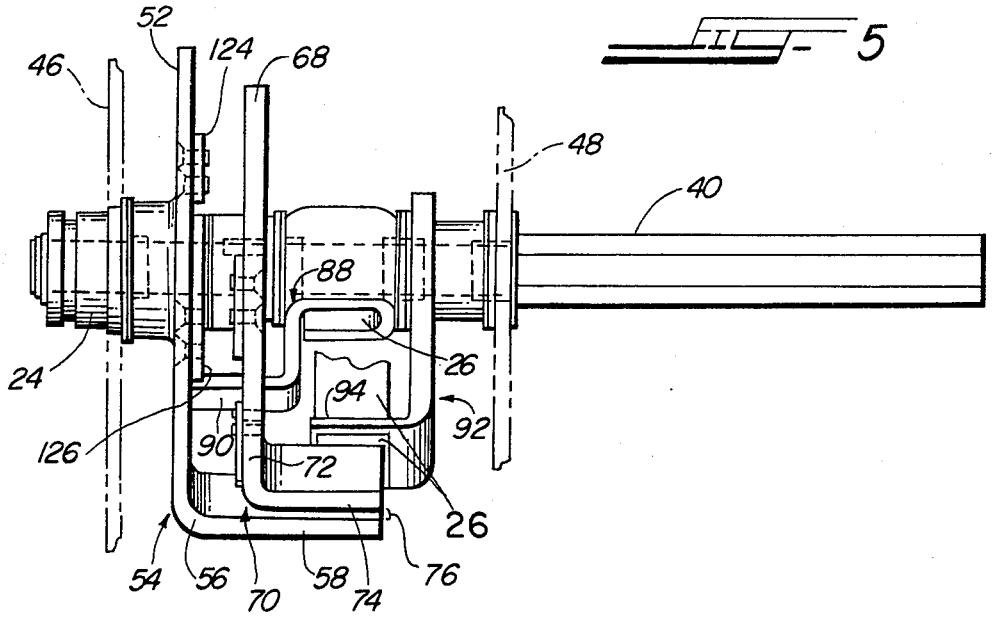
FIG. 5 is a cross-sectional fragmentary view of a spiral spring mechanism according to the present invention taken along line 5—5 of FIG. 3.

Referring now to FIGS. 2,3 and 5–9, the main shaft 40 is journaled for rotation in structural members 46,47,48 and 50. Carried coaxially on, and independently rotatable with respect to, the main shaft 40 is an output lever 52. The output hub 24 is formed integrally with, or is otherwise attached to, the output lever 52 for rotation therewith. As best seen in FIGS. 2 and 5, the output hub 24 is to the left of the structural member 46 while the output lever 52 is to the right thereof.

The output lever 52 is a disk-like member having a tang 54 (FIGS. 3 and 5–9) extending away from the periphery thereof. The tank 54 comprises an arm 56, coplanarly depending from the lever 52, and a leg 58 at right angles to the plane of the arm 56 and the lever 52. When the lever 52 rotates on the main shaft 40, the leg 58 also rotates coaxially thereof. The periphery of the lever 52 is notched as at 60, (FIGS. 3 and 6–9), the notch 60 being generally diametrically opposite the tang 54. The notch 60 has opposed end surfaces 62 and 64 which are on radii of the lever 52. Formed through the plane of the lever 52 is an arcuate slot 66 which subtends an angle of about 150° and runs from a radius of the lever 52 which approximately bisects the notch 60 to a point just short of a radius coterminal with the tang 54. The slot 66 is generally coaxial with main shaft 40.

Figure 3:
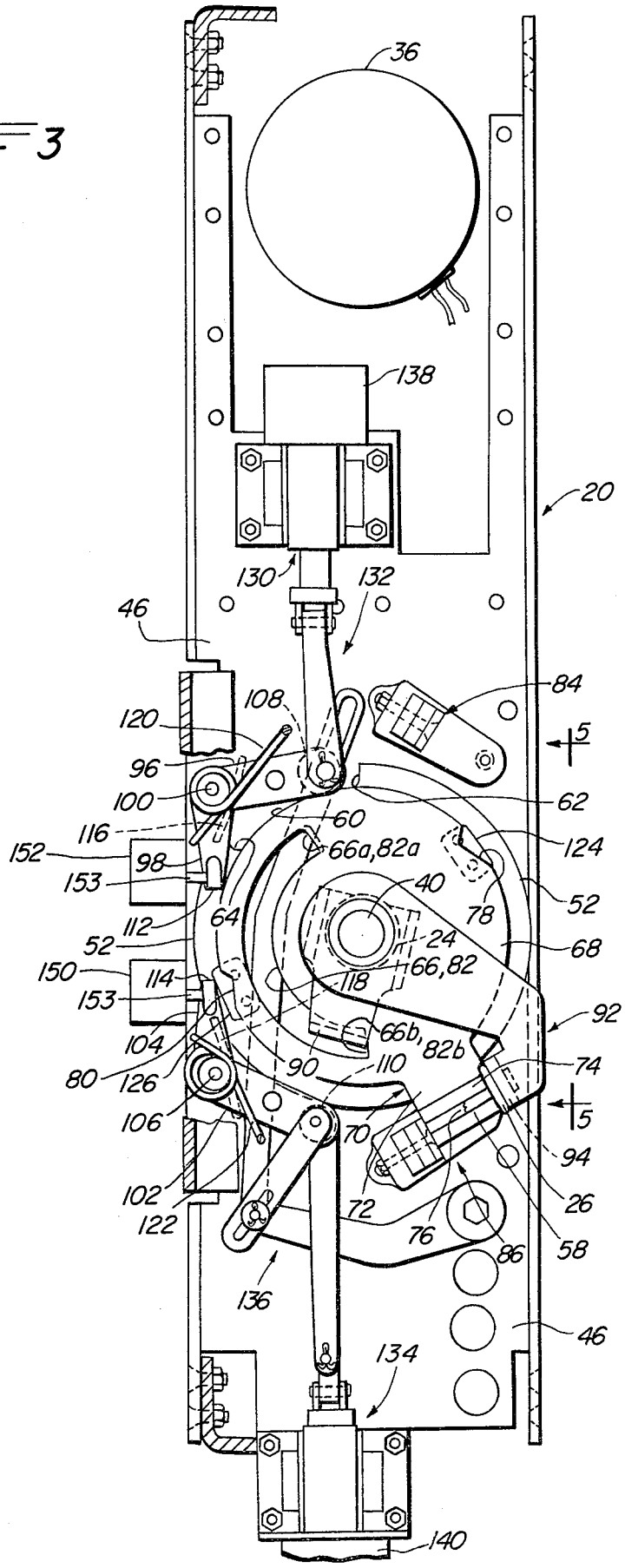
FIG. 3 is a partial cross-sectional rear view taken along line 3—3 of FIG. 2.

Fixed to the main shaft 40 to the right of the output lever 52 in (FIGS. 2 and 5) is a drive lever 68. The drive lever 68 is a disk-like member having a tang 70 extending from the periphery thereof. The tang 70 comprises an arm 72, coplanarly depending from the lever 68, and a leg 74 at right angles to the plane of the arm 72 and the drive lever 68 (FIGS. 3 and 5). The planes of the levers 52 and 68 are parallel as are the planes of the arms 56 and 72 and the planes of the legs 58 and 74. The diameter of the drive lever 68 is less than that of the output lever 52, and the length of the arm 72 is less than that of the arm 56. Accordingly, the legs 58 and 74 which both extend rightwardly in FIG. 5 are slightly spaced apart as shown at 76 in FIGS. 3 and 5. Thus, the levers 52 and 68 may rotate independently and the legs 68 and 74 do not interfere with this independent rotation. The leg 74 turns inside of, and coaxial with the arc described by rotation of, the leg 58.

The periphery of the drive lever 68 is notched as at 78 and 80 (FIGS. 3 and 6–9), the notches 78 and 80 being about 150° apart. Also formed through the drive lever 68 is an arcuate slot 82 which subtends an angle about 150° and is bisected by a radius of the lever 68 which intersects the notch 80. The slot 82 is coaxial with the main shaft 40.

As shown in FIG. 3, rotation of the output lever 52 is limited to about 120° by a pair of opposed stops 84 and 86 mounted to the structural member 46. The stops 84 and 86 lie in the paths traversed by the leg 58 when the lever 52 rotates. As best shown in FIG. 2, rotation of the drive lever 68 is limited to about 120° by a pin 87 fixed to the structural member 50. The pin 87 extends through an arcuate slot (not shown) in the sprocket 38. The slot subtends an arc of about 120° and abutment of the slot ends against the pin 87 thereby limits rotation of the lever 68 to this extent.

Referring to FIGS. 2 and 5–9, the spiral spring 26 is positioned about the main shaft 40. The spring 26 as it would be viewed in FIGS. 3 and 6–9 runs from its inner end to its outer end in a counterclockwise spiral. The inner end of the spring 26 is attached to an inner arbor 88 which extends away from the main shaft 40 and then leftwardly (FIG. 5) terminating in a tang 90. The tang 90 may be rotated about, and is parallel to, the main shaft 40. The tang 90 extends through the slots 66 and 82 in the levers 52 and 68 (into the plane of FIGS. 3 and 6–9; leftwardly in FIG. 5) and intercepts the paths taken by ends 66*a* and *b* and 82*a* and *b* of the slots 66 and 82 as the levers 52 and 68 rotate. The outer end of the spring 26 is attached to an outer arbor 92. Specifically, the outer end of the spring 26 is attached to a leg 94 of the outer arbor 92 which extends lefwardly in FIG. 5 (into the plane of FIG. 3) parallel to the main shaft 40. The main body of the outer arbor 92 is journaled for independent rotation on and about the main shaft 40 to rotate the leg 94. The leg 94 intercepts the paths taken by the legs 58 and 74.

As viewed in FIGS. 3 and 6–9, energy may be stored in the spring 26 in one of two ways;

(1) The inner arbor 88 may be held while the outer arbor 92 is rotated counterclockwise. If the outer arbor 92 is then held and the inner arbor 88 is released, the inner arbor 88 rotates counterclockwise;

(2) The outer arbor 92 may be held while the inner arbor 88 is rotated clockwise. If the inner arbor 88 is then held and the outer arbor 92 is released, the outer arbor 92 rotates clockwise.

Figure 7:
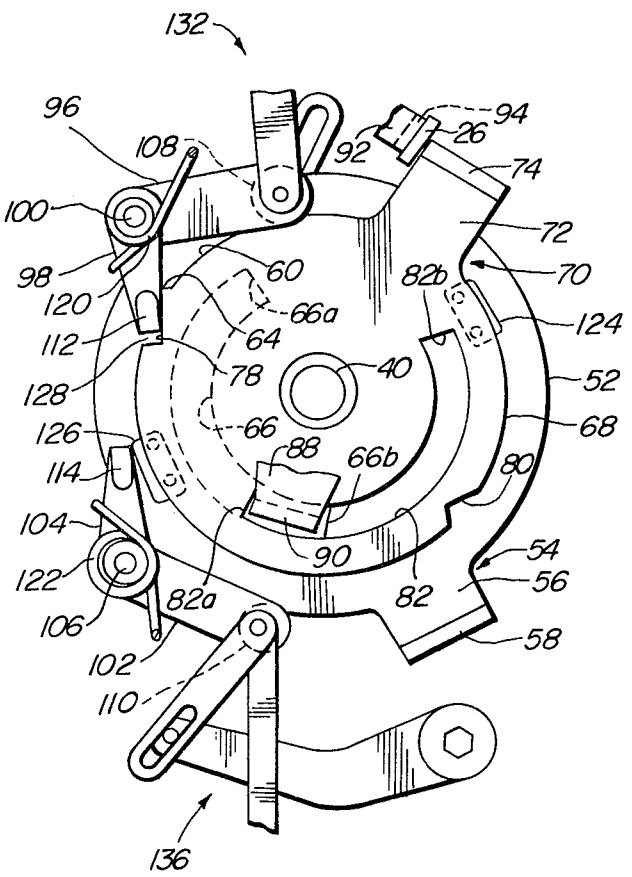
FIGS. 6 through 9 are fragmentary cross-sectional view taken substantially along line 6—6 in FIG. 2 showing a portion of the operating mechanism of the present invention in varying conditions thereof.
Figure 6:
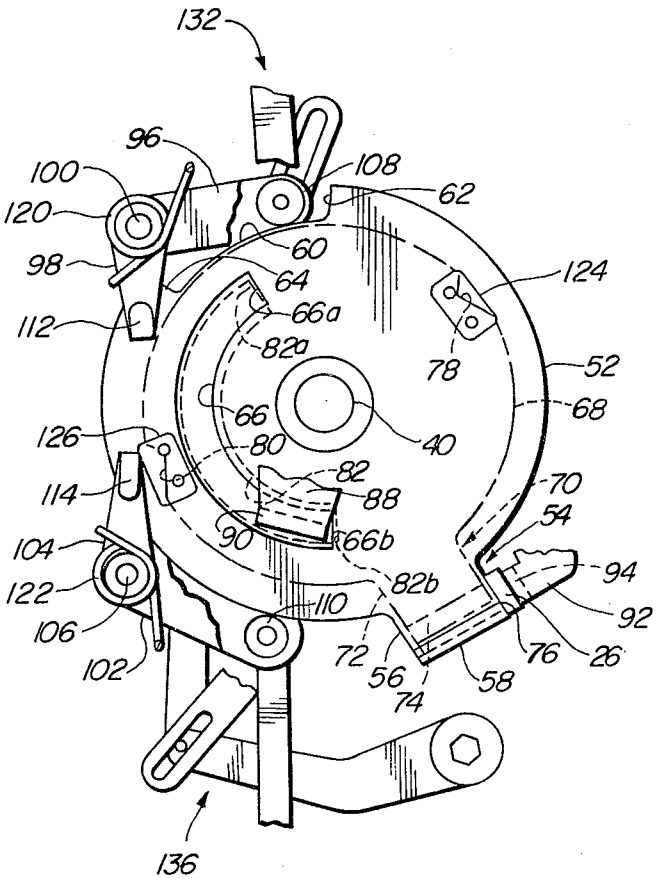

Referring to FIGS. 3 and 6, the spring 26 is shown discharged; the switch 14 has been opened due to a previous clockwise rotation of the output hub 24 by the output lever 52. The slots 66 and 82 overlie each other. One side of the tang 90 extends through and rests against the ends 66*b* and 82*b* of the slots 66 and 82. Both legs 58 and 74 rest against, or are near, the stop 86 and the leg 94 of the outer arbor 92 and the outer end of the spring 26 rest against the legs 58 and 74. To charge the spring 26 to close the switch 14, the main shaft 40 is rotated counterclockwise by the motor 36 and the geartrain assembly 32. Counterclockwise rotation of the main shaft 40 rotates the drive lever 68 and its connected leg 74 counterclockwise, the leg 74 moving away from the stop 86. The leg 74 bears against the outer end of the spring 26, and accordingly rotates the leg 94 of the outer arbor 92 counterclockwise. Assuming that the output lever 52 is held, as discussed below, as the end 82*b* of the slot 82 in the drive lever 68 moves away from the tang 90, such tang 90 is held and prevented from rotating counterclockwise by the end 66*b* of the slot 66 in the held output lever 52. Energy to rotate the output lever 52 counterclockwise to close the switch 14 is thus stored in the spring 26, as shown in FIG. 7. After about 120° of rotation, the pin 87 abuts one end of the slot (not shown) in the sprocket 38 (FIG. 2), and the leg 74 of the drive lever 68 can turn counterclockwise no further. Also at this point, as seen in FIG. 7, the end 82*a* of the slot 82 approaches the tang 90. The spring 26, it may be said, has been wound up by holding its inner end stationary and rotating its outer end.

Figure 8:
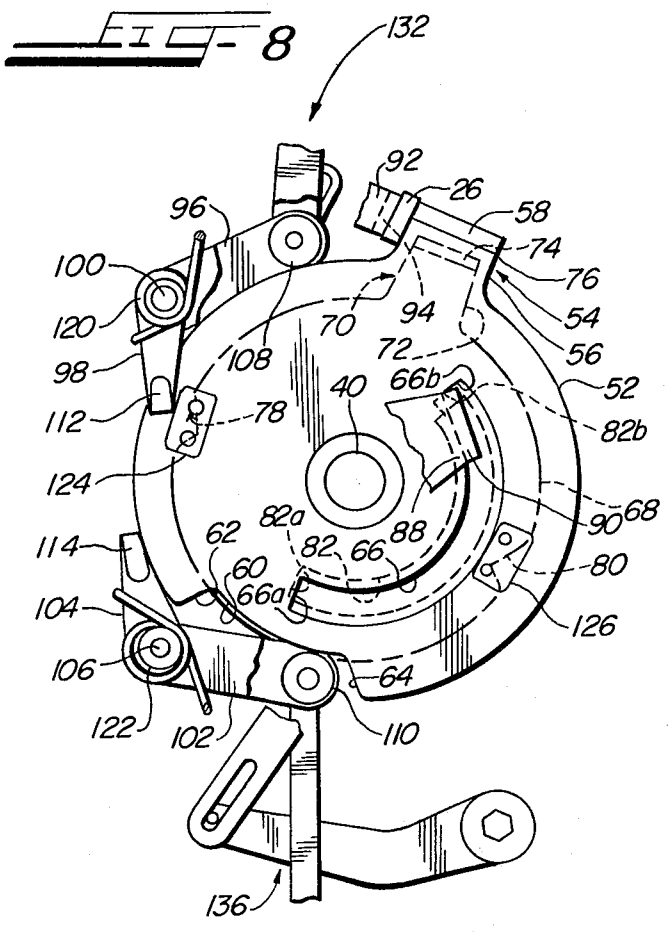

If the drive lever 68 is now held, as discussed below, and the output lever 52 is released, also as discussed below, the energy stored in the spring 26 rotates the output lever 52 and its connected output hub 24 counterclockwise to close the switch 14. Specifically, and starting with FIG. 7, stored energy moves the tang 90 counterclockwise against the end 66*b* of the slot 66 in the output lever 52 which rotates the lever 52 counterclockwise until the leg 58 abuts the stop 84. At this point, rotation of the output hub 24 ceases and, as shown in FIG. 8, the slots 66 and 82 again overlap with the tang 90 abutting the ends 66*b* and 82*b* of both slots 66 and 82. FIG. 8, accordingly, depicts the spring 26 in the discharged state with the switch 14 closed.

Figure 9:
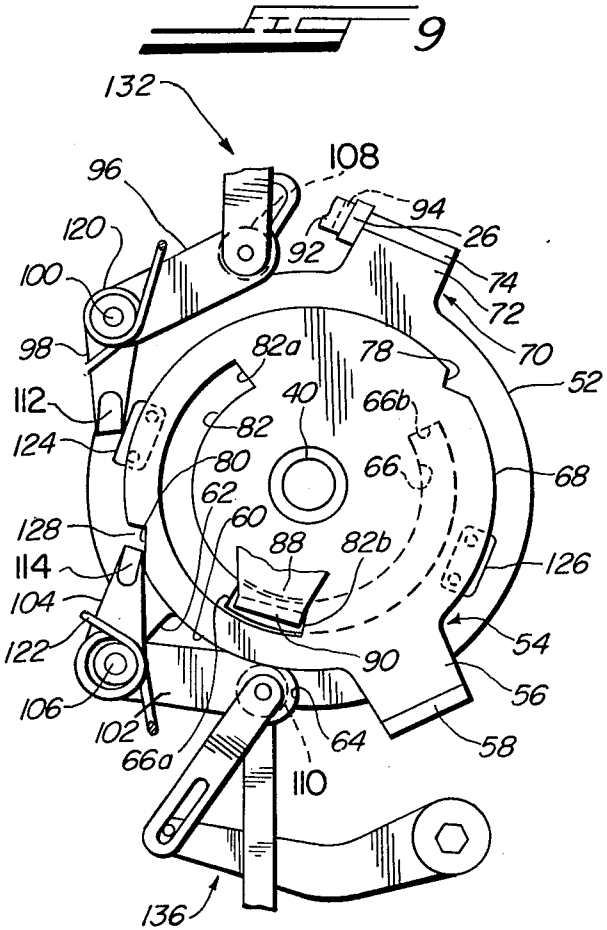

To charge the spring 26 to open the switch 14, the main shaft 40 is rotated clockwise while the output lever 52 is held. Starting with FIG. 8, clockwise rotation of the main shaft 40 rotates the drive lever 68 clockwise as well as the end 82*b* of the slot 82 abutting the tang 90. As the drive lever 68 rotates clockwise, the tang 90 and the inner arbor 88, are rotated clockwise. Because the output lever 52 is held, its leg 58 maintains the leg 94 of the outer arbor 92 stationary. Thus, clockwise rotation of the drive lever 68 winds the spring 26, this time from the inner end, while the outer end is held. Clockwise rotation of the drive lever 68 continues for 120° until the pin 87 abuts an end of the slot in the sprocket 38. At this point, as seen in FIG. 9, the opposite end 66*a* of the slot 66 in the output lever 52 is approached by the tang 90.

If the drive lever 68 is now held as discussed below, and the output lever 52 is released, also as discussed below, the energy stored in the spring 26 rotates the output lever 52 and its connected output hub 24 clockwise to open the switch 14. Specifically, the stored energy moves the arbor 92 clockwise which rotates the leg 72 on the output lever 52 clockwise. This continues until the leg 72 contacts the stop 86. The conditions shown in FIGS. 3 and 6 again obtain.

Referring now especially to FIGS. 3 and 6–9, a first roller arm 96 and a first latch arm 98 are pivotally mounted to the structural member 46 by a pin 100 for independent pivoting thereon. A second roller arm 102 and a second latch arm 104 are similarly mounted by a pin 106. The roller arms 96 and 102 carry rollers 108 and 110, respectively, at their ends remote from the pins 100 and 106. The latch arms 98 and 104 carry latch members 112 and 114, respectively at their ends remote from the pins 100 and 106. A spring 116 attached between the roller arm 96 and the structural member 46 biases the roller arm 96 to hold the roller 108 against the periphery of the output lever 52 including the notch 60. A spring 118 attached between the roller arm 102 and the structural member 46 similarly holds the roller 110 against the periphery of the output lever 52. A spring 120 attached between the latch arm 98 and the structural member 47, biases the latch arm 98 to hold the latch member 112 against the periphery of the drive lever 68 including the notch 78. A spring 122 similarly holds the latch member 114 against the periphery of the drive lever 68 including the notch 80.

The output lever 52 carries on its surface a pair of kickers or cams 124 and 126. The kickers 124 and 126 are configured to contact the latch members 112 and 114, respectively, as the output lever 52 rotates. As seen in FIGS. 3, 6 and 8, whenever the slots 66 and 82 completely overlap, the kickers 124 and 126 are respectively adjacent the notches 78 and 80.

As shown in FIGS. 3 and 6, the spring 26 is discharged and the switch 14 is open. The notch 60 in the output lever 52 is so positioned that the roller 108 engages the end 62 thereof due to the action of the spring 116. This prevents counterclockwise rotation of the output lever 52. The kicker 126 is so positioned as to contact the latch member 114 holding it out of the notch 80 to permit counterclockwise rotation of the drive lever 68. Counterclockwise rotation of the main shaft 40, as described above, rotates the drive lever 68 counterclockwise. Because the output lever 52 is held by the roller 108, this action stores energy in the spring 26, winding its outer end (via the leg 94) while its inner end is held (via the tang 90). Just before the leg 94 abuts the stop 84, the notch 78 is positioned adjacent the latch member 112, and the latch member 112 enters the notch 78 under the action of the spring 120. As the pin 87 stops rotation of the lever 68, the notch 78 moves slightly past the latch member 112 as shown by the lost motion gap 128 in FIG. 7. The lost motion gap 128 is required to ensure that the latch member 112 enters the notch 78 notwithstanding tolerance variations of the various elements of the operator 20. When rotation of the main shaft 40 ceases, the energy now stored in the spring 26 rotates the drive lever 68 slightly clockwise, fully seating the latch member 112 in the notch 78 to hold the drive lever 68 against clockwise rotation.

The switch 14 is closed by pivoting the roller arm 96 on the pin 100 against the spring 116 to pull the roller 108 out of the notch 60 and out of engagement with the surface 62 thereof. As more fully explained in the '123 application, this may be effected electrically by a solenoid 130 connected by appropriate linkages, generally indicated at 132, to the first roller arm 96 (FIG. 3).

Movement of the roller 108 is followed by counterclockwise rotation of the output lever 52 and of the output hub 24 to close the switch 14. Near the end of the rotation of the output lever 52, the kicker 124 contacts the latch member 112, lifting it out of the notch 78 to free the drive lever 68 for clockwise rotation during a subsequent operation to recharge the spring 26 for opening the switch 14. Also, the notch 60 is entered by the roller 110 which ultimately bears against the surface 64 to hold the output lever 52 for such subsequent energy storage operation. The conditions of FIG. 8 obtain at this time. The spring 26 is discharged and the switch 14 is closed.

To recharge the spring 26, the above-described clockwise rotation of the drive lever 68 is effected by clockwise rotation of the main shaft 40. The roller 110 holds the output lever 52 against rotation. As seen in FIG. 9, clockwise rotation of the drive lever 68 continues for 120° until the pin 87 stops such rotation and the latch member 114 enters the notch 80, holding the drive lever 68. To open the switch 14, the roller 110 is pulled away from the end 64 of the notch 60 allowing the output lever 52 and the attached output hub 24 to rotate clockwise, under the influence of the spring 26 and the leg 94, until the conditions in FIGS. 3 and 6 again obtain. The kicker 126 lifts the latch member 114 out of the notch 80 for a subsequent rewinding of the spring 26 to close the switch 14. Movement of the roller 110 may be effected by a solenoid 134 connected through linkages, generally indicated at 136, to the second roller arm 102, as more fully disclosed in the '123 application (FIG. 3).

Immediately following movement of the output lever 42 as the spring 26 discharges to operate the switch 14, it is intended that the motor 36 be immediately energized to immediately recharge the spring 26 for operation of the switch 14 in the opposite direction. This intended operation of the motor 36 may be either not possible or undesirable, for several reasons.

First, the switch blades 16 of the switch 14 must be rapidly rotated. This requires storage of high amounts of energy in the spiral spring 26 for rapid movement of the output lever 52 and its attached output hub 24. Both the high speed of the various elements of the operator 20 and the high amounts of energy stored in the spring 26 result in high impact forces including vibration and oscillation of the various elements of the operator 20 during its operation. As a consequence of these high forces (and of normal manfacturing tolerances,) certain difficulties in the operation of the operator 20 in accordance with the '123 application have been observed. A major difficulty has been that, following rotation of the output lever 52 in either direction, the rollers 108 and 110 may some times vibrate out of, or be impacted or otherwise moved out of, the notch 60. If either of the rollers 108 and 100 have moved out of the notch 60, for any reason, following movement of the output lever 52, subsequent energization of the motor 36 to rotate the main shaft 40 and the drive lever 68 for recharging the spring 26 will be ineffective, as the output lever 52 must be held during such recharging. Second, the normal inertia of the solenoids 130 and 134, of their linkages 132 and 136, and of the roller arms 96 and 102, can result in the rollers 108 and 110 attempting to move into the notch 60 too late, that is, after the motor 36 has been energized in an attempt to recharge the spring 26. Such a recharging operation wll be futile since the output lever 52 is not held. Third and more importantly, if the rollers 108 and 110 do not enter, or bounce out of, the notch 60, rotation of the drive lever 68 causes the output lever 52 to "follow" it, which in some cases could be disastrous. For example, if the output lever 52 "follows" the drive lever 68 following the opening of the switch 14 due to a fault in the circuit, such movement of the output lever 52 closes the switch 14 into the fault. This could lead to damage to the switch 14 and to the circuit. Also, the "following" by the output lever 52 is effected at a relatively slow speed; the drive lever 68 is moved by the motor 36 at such a slow speed. Slow movement of the output lever 52 effects slow operation of the switch 14. The switch 14 is intended to be opened and closed rapidly, and its slow operation can lead to its damage or destruction.

The failure of the rollers 108 and 110 to enter the notch 60 may also be due to less than complete rotation of the output lever 52. This could be due to some untoward blockage of the operator 20, or to some blockage of the switch 14. Should the switch 14 not have been operated, it is desirable not to attempt to recharge the spring 26 for an operation in the opposite direction. There are two reasons for this. First, a complete switch operation has not been previously effected and one was desired, as indicated by the attempt of the output lever 52 to rotate the switch blades 16. Second, as before, any attempt to recharge the spring 26 will be futile in any event, because the output lever 52 is not held.

The present invention is, therefore, intended inter alia to ensure proper functioning of the rollers 108 and 110 so that appropriate cycles of operation of the switch operator 20 may be effected. It is again emphasized that immediately following the closing of the switch 14 by the operator 20, it is intended that the drive lever 68 is rotated and the output lever 52 is held to charge the spring 26 for a subsequent opening operation selectively effected at some later time by the solenoid 134. Similarly, it is intended that immediately following opening of the switch 14 by the operator 20, the drive lever 68 is rotated and the output lever 52 is held to recharge to spring 26 to subsequently close the switch 14. Such closing is selectively effected at some later time by the solenoid 130.

Figure 10:
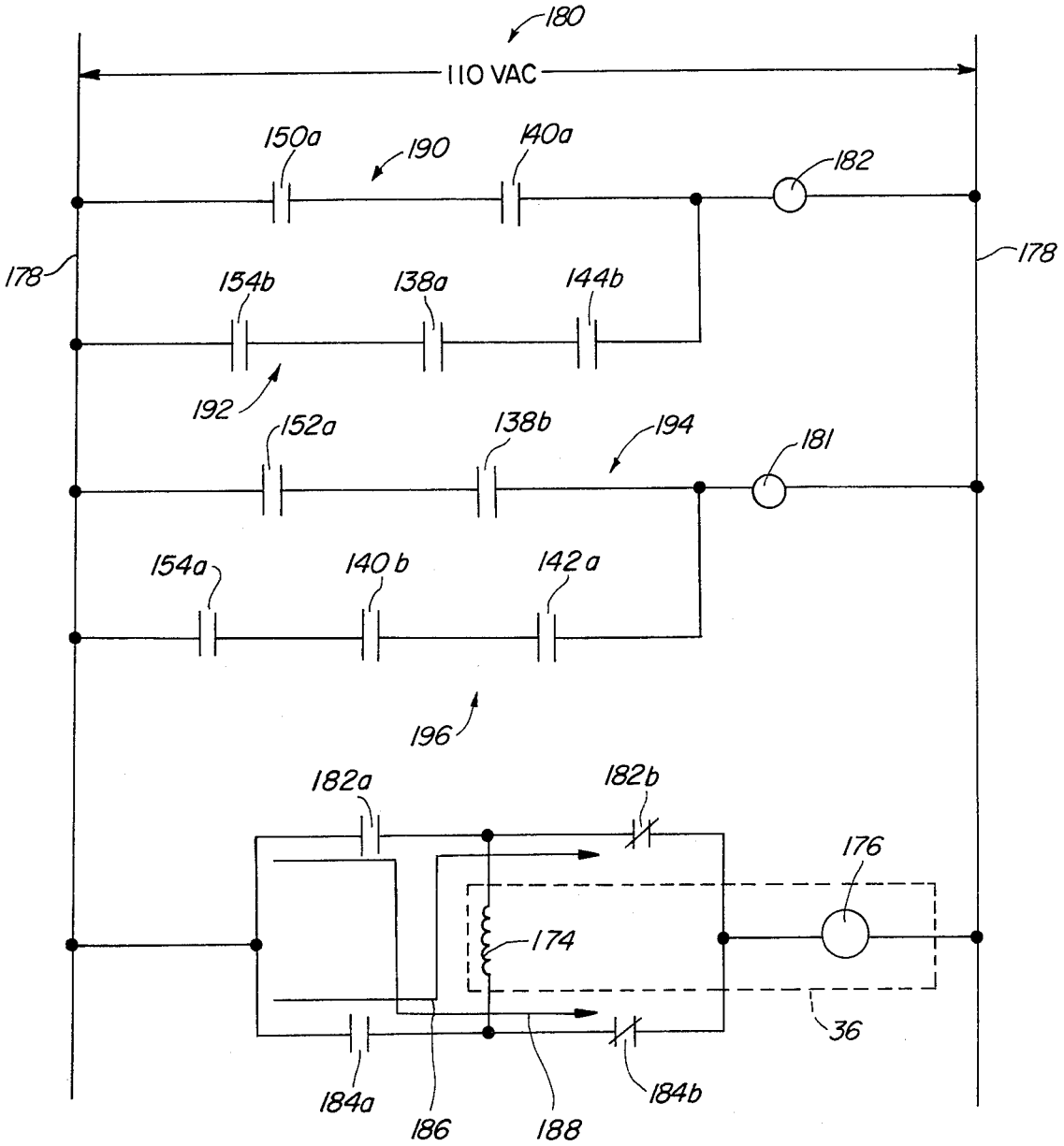
FIG. 10 is a schematic diagram of a control system for the switch operating mechanism hereof.

The improved operator 20 of the present invention includes various sensors, hereinafter described, which are used to control the operation of the motor 36 in accordance with the condition of various elements of the operator 20. An electrical schematic diagram of various contacts controlled by such sensors, and of the motor 36, is depicted in FIG. 10. It should be understood that while the sensors described herein are simple switches containing one or more contact pairs, other appropriate sensors may be used.

Referring to FIGS. 2,3 and 10, a first switch 138 or other sensor is connected to, or otherwise associated with, the solenoid 130. The first switch 138 has two contact pairs **138*a* and 138*b*. The contacts 138*a* are closed if the roller 108 is not in the notch 60 and are open if the roller 108 is in the notch 60. The contacts 138*b* are closed if the roller 108 is in the notch 60 and are open if the roller 108 is not in the notch 60. The switch contacts 138*a* and 138*b* may be appropriately associated with the operating member or plunger of the solenoid 130** by any appropriate facility or connection, as is well known.

A second switch 140 is associated with the solenoid 134 in a manner similar to the association of the first switch 138 with the solenoid 130. The second switch 140 has two contact pairs **140*a* and 140*b*. The contacts 140*a* are closed when the roller 110 has entered the notch 60 and are opened when the roller 110 is not within the notch 60. The contacts 140*b* are open when the roller 110 is within the notch 60 and are closed when the roller 110 is not within the notch 60**.

Figure 4:
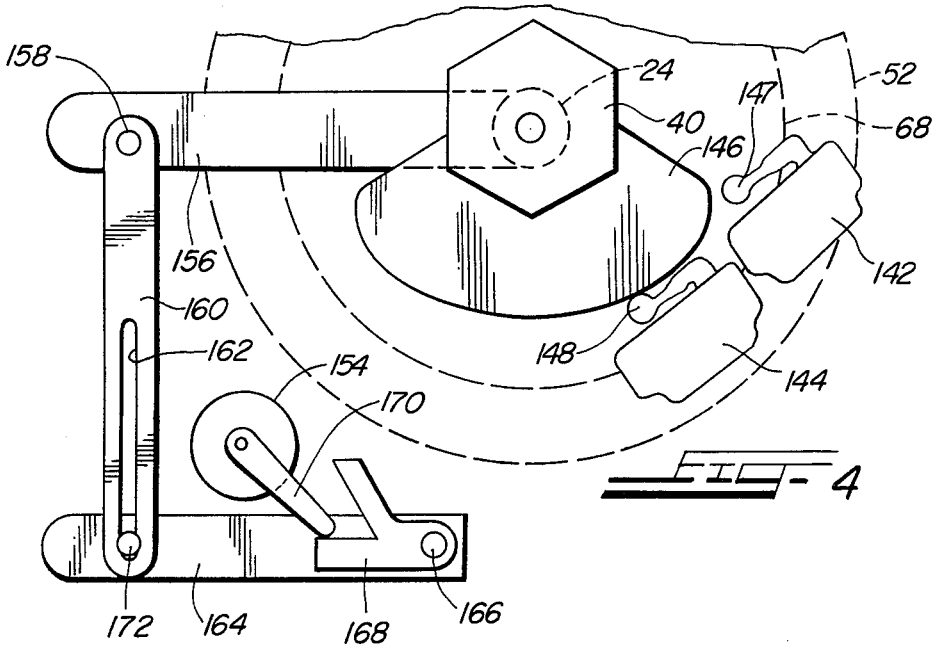
FIG. 4 is a view of some elements of the mechanism of the present invention not visible in other views.

Referring to FIGS. 4 and 10, a third switch 142 and a fourth switch 144 are provided for sensing the rotational position of the main shaft 40 and, therefore, of the drive lever 68. The switches 142 and 144 may be separate switches (as shown) operated by a single cam, separate switches operated by different cams, or, the same switch operated by the same cam. The third switch 142 has a pair of contacts **142*a* which are opened when the main shaft 40 and the drive lever 68 are fully clockwise. The contacts 142*a* close shortly (10°–20°) after the main shaft 40 and the drive lever 68 begin to rotate counterclockwise to charge the spring 26 for closing the switch 14, and which remain closed when the main shaft 40 and the drive lever 68 are fully counterclockwise and the drive lever 68 is held by entry of the latch member 112 into the notch 78. The contacts 142*a* open just before the main shaft 40 and the drive lever 68** go fully clockwise from their fully counterclockwise position, preferably 10 to 20 degrees therebefore.

The switch 144 has a single set of contacts 144*b* which are closed when the main shaft 40 and the drive lever 78 are fully clockwise and which open approximately 10 to 20 degrees before the main shaft 40 and the drive lever 78 go fully counterclockwise. The contacts 144*b* remain open when the main shaft 40 and the drive lever 78 are fully counterclockwise and close shortly after (10 to 20 degrees) the main shaft 40 and the drive lever 78 begin to rotate clockwise. The switches 142 and 144 may be appropriately associated with the main shaft 40 in any well known manner. For example, a cam 146 may be attached to the main shaft 40 as shown in FIG. 4. Respective operating members 147 and 148 of the switches 142 and 144 are appropriately operated by the cam 146 as the main shaft 40 rotates. Separate cams may also be used.

Referring to FIGS. 3 and 10, a fifth switch 150 and a sixth switch 152 are provided for sensing the condition of the latch members 114 and 112. Specifically, the switch 150 has a single set of contacts 150*a* which are closed if the latch member 114 is in any position other than within the notch 80 and which are open only if the latch member 114 is within the notch 80. The switch 152 has a single set of contacts 152*a*, which are closed if the latch member 112 is in any position other than in the notch 78, and which are open only if the latch member 112 is within the notch 78. As shown in FIG. 3 the switches 150 and 152 may be simply fastened to the structural members 46 or 47 and may have plungers 153 attached to, or otherwise operated by, the latch arms 98 and 104, or in any other convenient manner so as to properly open or close the contacts 150*a* and 152*a*.

Figure 11:
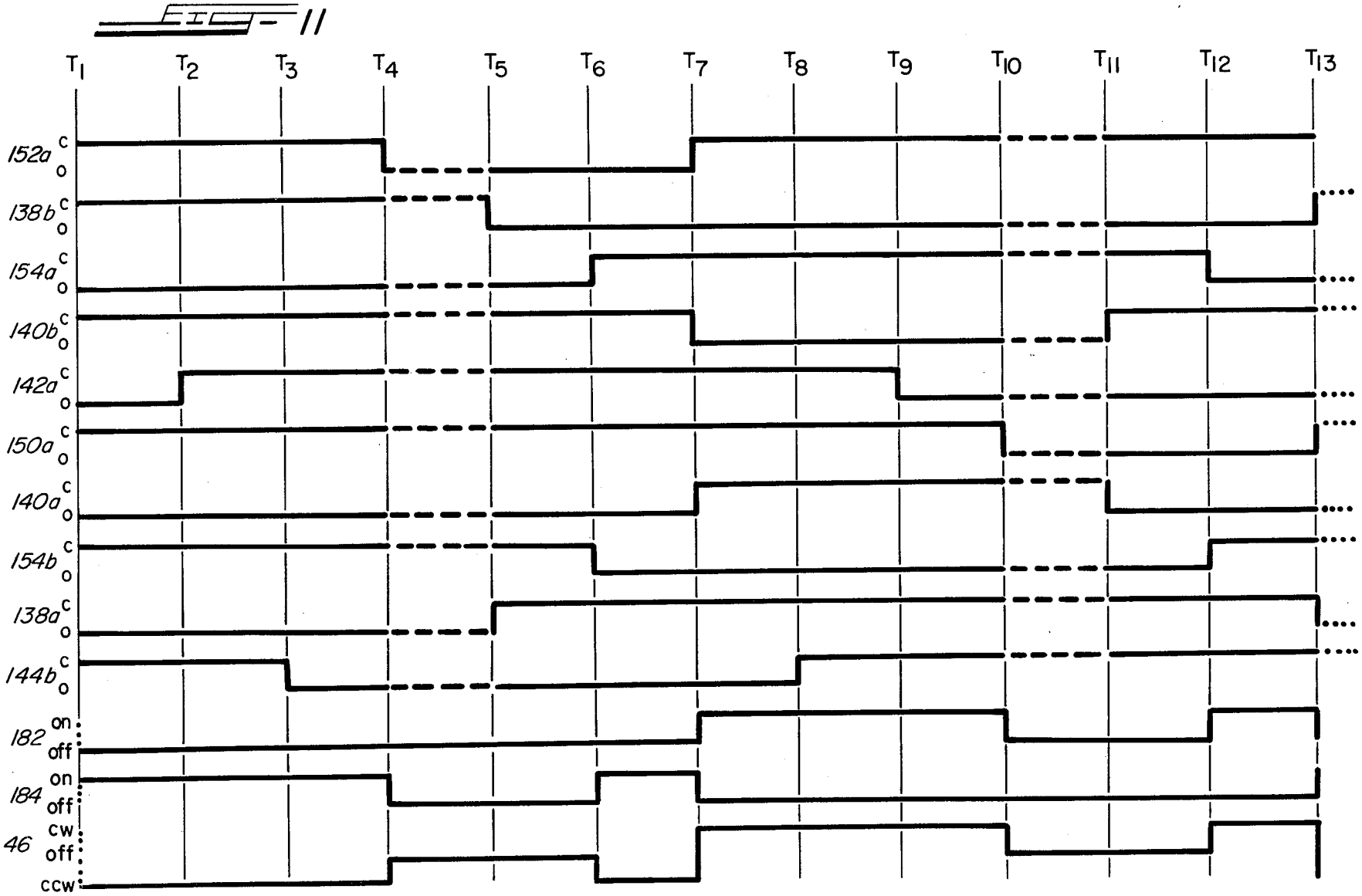
FIG. 11 is a timing diagram for various elements of the control system of FIG. 10.

Referring to FIGS. 4 and 10, a seventh switch 154 is responsive to the rotational position of the output lever 52, the output hub 24, and the switch 14. The switch 154 has two contact pairs 154*a* and 154*b*. The contacts 154*b* are opened when the output lever 52 is fully counterclockwise (indicating that the switch 14 has been closed), close some time (10 to 20 degrees) before the output lever 52 is fully clockwise and the switch 14 is opening, remain closed when the output lever 52 is fully clockwise and the switch 14 is open, and open just before (10 to 20 degrees) the outout lever 52 is fully counterclockwise and the switch 14 is closing. See FIG. 11. The contacts 154*a* are closed when the output lever 52 is fully counterclockwise and the switch 14 is closed, open just before (10 to 20 degrees) the output lever 52 is fully clockwise and the switch 14 is opening, remain open when the output lever 52 is fully clockwise and the switch 14 is open, and are closed a short period before (10 to 20 degrees) the output lever 52 is fully counterclockwise and the switch 14 is closing. See FIG. 11.

As shown in FIG. 4, the switch 154 may be a rotational switch containing therewithin the contact pairs 154*a* and 154*b*. The contact opening and closing sequence described immediately above may be effected inter alia as follows. Connected to either the output lever 52 or to the output hub 24 may be an arm 156 which rotates therewith. Pivotally connected by a pin 158 to the arm 156 is a slotted link 160 having a slot 162 formed longitudinally therein. The link 160 is pivotally connected to one end of an arm 164, the other end of which is pivotally connected by a pin 166 to one of the structural members 46,47,48 or 50. The arm 164 carries a furcated operating member 168, between the furcations of which a pin-carrying operating member 170 of the switch 154 is positioned. The arm 164 is connected to slotted link 160 by a pin 172 which freely slides in the slot 162 until it abuts the ends thereof. Noting that FIG. 4 has the same aspect as FIG. 3, rotation of the arm 156 in the counterclockwise direction is indicative of opening of the switch 14. In the position shown, it is assumed that arm 156 has been rotated fully clockwise and accordingly as viewed in FIG. 4, the output lever 52 is rotated fully clockwise causing the contacts 154*b* to be closed and the 154*a* to be open. If, the arm 156 rotates counterclockwise, the condition of the switch contacts 154*a* and *b* does not change for some time because of relative movement between the slot 162 and the pin 172 which leaves the operating members 168 and 170 in the positions shown in FIG. 4 and does not effect the condition of the switch 154. When the upper end of the slot 162 reaches the pin 172, the arm 164 and the operating member 168 are rotated downwardly, as is the operating member 170, to open the contacts 154*b* and close the contacts 154*a* just before (10 to 20 degrees) the arm 156 and the output lever go fully counterclockwise. With the switch contacts 154*a* and *b* in this condition, the arm 156 may be subsequently rotated clockwise. The contacts 154*a* and *b* will remain in the last-noted condition until just before (10 to 20 degrees) the lever 52 goes fully clockwise to close the contacts 154*b* and to open the contacts 154*a*. As should be clear, any other arrangement for mounting the switch 154 or a different type of switch than that depicted at 154 may be used.

Turning now to FIG. 10, the motor 36 is seen to include a field winding 174 and an armature 176. The field winding 174 and the armature 176 are connected together, as described below, between a pair of conductors 178 connected to a source of supply voltage 180, such as 110–120 volts ac. As described below, the above-described contacts are variously connected in series with operating coils 182 and 184 which are similarly connected to the conductors 178.

The operating coil 182 controls a pair of contacts 182*a* and 182*b* and the coil 184 controls a pair of contacts 184*a* and 184*b*, the contacts 182*a* and *b*, and 184*a* and *b*, being connected to the field 174 as described hereinafter.

The contacts 182*a* and 182*b* are connected in series between one of the conductors 178 and the armature 176 of the motor 36, the other end of the armature 176 being connected to the other conductor 178. The contacts 182*a* are normally open and the contacts 182*b* are normally closed. When the coil 182 is energized by the ac source 180, the conditions of the contacts 182*a* and 182*b* reverses. Specifically, the contacts 182*a* close and the contacts 182*b* open. The contacts 184*a* and *b* are connected in series between one of the conductors 178 and one side of the armature 176 in parallel with the contacts 182*a* and 182*b*. The field winding 174 is connected between the series connection of these contacts as shown. The contacts 184*a* are normally open and the contacts 184*b* are normally closed, which states reverse when the coil 184 is energized.

When both coils 182 and 184 are de-energized, the contacts 182*a* and 184*a* are open and there is no current path from the ac source 80 through the armature 176 and the field 174. At this time, then, the motor 36 is de-energized. Should the coil 184 become energized, the contacts 184*a* close and the contacts 184*b* open. A current path 186 is provided through the field 174 via the now closed contacts 184*a* and the normally closed contacts 182*b*. Current flow through the field winding 174 along the path 186 effects counterclockwise rotation of the main shaft 40 via the motor 36 and the gear train assembly 42 to rotate the drive lever 68 in the counterclockwise direction as viewed in FIG. 3. Such counterclockwise rotation of the main shaft 40, as discussed above, charges the spring 26 to effect a closing operation of the switch 14. If, on the other hand, the coil 182 becomes energized while the coil 184 is de-energized, the normally open contacts 182*a* close and the normally closed contacts 182*b* open. This provides a current path 188 through the field 174 via the now closed contacts 182*a* and the normally closed contacts 184*b*. Current flow through the field winding 174 along the path 188 energizes the motor 36 to rotate the main shaft 40 via the gear train assembly 42 in a clockwise direction. Such clockwise rotation of the main shaft 40 charge the spring 26 for opening the switch 14.

The coil 182 is series-connected to a parallel combination of a plurality of the above-described contacts. Specifically, a first branch 190 is connected between the coil 182 and one of the conductors 178. The first branch 190 includes a series combination of the contacts 140*a* and 150*a*. A second branch 192 includes, in series, the contacts 138*a*, 144*b* and 154*b*. The coil 184 is similarly connected between the conductors 178 in series with a parallel combination of two branches 184 and 196. The first branch 194 includes the contacts 138*b* and 152*a*, and the second branch includes the contacts 140*b*, 142*a* and 154*a*.

The coil 182 is energized if, and only if, the contacts 140*a* and 150*a* in the first branch 190 are both closed, or the contacts 138*a*, 144*b* and 154*b* are all closed in the second branch 192. The first branch 190 is referred to herein as the "normal branch" and the second branch 192 is referred to herein as the "anti-bounce" branch. Similarly, the coil 184 is energized if and only if both contacts 138*b* and 152*a*, in the first branch 194 are closed, or the contacts 140*b*, 142*a* and 154*a* in the second branch 196 are all closed. Again, the first branch 194 is the "normal" branch and the second branch 196 is the "anti-bounce" branch.

Referring now to FIGS. 3,4,10 and 11, the operator 20 is in a condition in FIG. 3 wherein the spring 26 has just been discharged by opening the switch 14. The "normal" branch 194, including the contacts 138*b* and 152*a* supplies current to the coil 184, thereby closing the normally opened contacts 184*a* and opening the normally closed contacts 184*b* to provide current flow along the path 186 through the field 174; the motor 36 rotates in a direction to rotate counterclockwise the main shaft 40, charging the spring 26 for a subsequent closing of the switch 14. Specifically, and at time $T_1$ in FIG. 11 the contacts 152*a* are closed because the latch member 112 is not in the notch 78, as described above. Moreover, the contacts 138*b* are closed because the roller 108 is within the notch 60 and is engaging the end surface 62 thereof. Since the output lever 52 is held by the roller 108 and the position thereof will not change during charging of the spring 26 as described above, the contacts 138*b* will remain closed. The contacts 152*a* on the other hand will open when the latch member 112 enters the notch 78 following full counterclockwise rotation of the drive lever 68. At this point, the motor 36 becomes de-energized and the levers 68 and 52 are held stationary until the roller 108 is removed from the notch 60 to effect closing of the switch 14 as described above. As the spring 26 is being wound, at least one switch in every other branch 190,192 and 196 is open so that only the coil 184 is energized by the first branch 194. Specifically, the contacts 140*a* are open because the roller 110 is not within the notch 60. The contacts 138*a* are open because the roller 108 is in the notch 60. The contacts 154*a* are open because the output lever 52 is rotated fully clockwise. Lastly, the contacts 142*a* are opened because the drive lever 68 is fully clockwise.

As the motor 36 rotates the drive lever 68 to charge the spring 26, certain changes in the conditions of some contacts occur. Specifically, the contacts 142*a* close a short time after the drive lever 68 begins to rotate counterclockwise, as seen at time $T_2$ in FIG. 11. This has no effect on the energizing path for the coil 184. Shortly thereafter, the contacts 144*b* open just before (10 to 20 degrees) the drive lever 68 is fully clockwise as seen at time $T_3$ in FIG. 11. Again, this has no effect on the energized state of the coil 184 or on the operation of the motor 36. Shortly after this time, the contacts 152*a* open if the latch member 112 enters the notch 76; see time $T_4$ in FIG. 11. This does have an effect on the energization of the coil 184. Specifically, the coil 184 is deenergized and the motor 36 ceases operation. If for some reason the latch 112 does not enter the notch 78, the coil 184 remains energized and the motor 36 continue to operate in an attempt to rotate the drive lever 68 to a position whereat the latch member 112 may enter the notch 78.

Assuming that the latch member 112 does enter the notch 78 and that the motor 36 is de-energized, the switch operator 20 undergoes no further operations (left-hand dotted lines between times $T_4$ and $T_5$ in FIG. 11) until it becomes necessary to close the switch (time $T_5$). As more fully disclosed in the '123 application, switch closure is effected by energization of the solenoid 130 which pulls the roller 108 out of the notch 60 permitting the output lever 52 to rotate counterclockwise under the action of the previously charged spring 26. The switch 14 is thus opened. Movement of the roller 108 out of the notch 60 causes closure of the previously opened contacts 138*a* and opening of the previously closed contacts 138*b* (time $T_5$). A change in state of these contacts has no effect on either of the coils 182 or 184 during the time that the output lever 52 is rotating to open the switch 14. When the output lever 52 completes its rotation in the counterclockwise direction, the roller 110 is intended to enter the notch 60 to hold the output lever 52 for a subsequent recharging of the spring 26. To this end, the so-called anti-bounce branch 196 is activated to energize the coil 184 at a time when the output lever 52 is approximately 10 to 20 degrees away from its full counterclockwise rotation. Specifically, contacts 142*a* are closed because the drive lever 68 is fully counterclockwise. The contacts 140*b* are closed because the roller 110 has not yet entered the notch 60. Lastly, the contacts 154*a* are closed just before (about 10 to 20 degrees) the output lever 52 is fully counterclockwise. See time $T_6$ in FIG. 11. Should the roller 110 enter the notch 60 as desired, the contacts 140*b* open (Time $T_6$), again de-energizing the coil 184 and the motor 36. If, however, for some reason, the roller 110 does not enter the notch 60 or bounces out of the notch 60 due to the high energies and impact forces involved in operation of the switch operator 20, the contacts 140*b* remain closed and continue to energize the coil 184.

When the coil 184 is re-energized following movement of the output lever 52 which approaches full counterclockwise rotation thereof, but with the roller 110 not entering the notch 60, the motor 36 is re-energized. This re-energization of the motor 36 re-initiates rotation of the drive lever 68 in the counterclockwise direction.

This action, in turn, attempts to charge the spring 26 in a direction which will close the switch 14, and applies a force to the output lever 52 in the counterclockwise direction. Thus, assuming that the notch 60 is in the vicinity of the roller 110, the continued operation of the motor 36, the continued rotation of the drive lever 68, and the continued charging of the spring 26 in the counterclockwise direction, all conjoin to hold the output lever 52 near, or in, a position whereat the roller 110 may enter the notch 60, or to attempt to move the output lever 52 to a position whereat the roller 110 can enter the notch 60 if such position has not been reached.

Following entry of the roller 110 into the notch 60, the contacts **140*b* open and the coil 184** is de-energized.

However, immediately following entry of the roller 110 into the notch 60, the contacts **140*a* close, (time $T_7$). Since the contacts 150*a* have already been closed because the latch member 114 is not in the notch 80, the normal branch 190 immediately energizes the coil 182. Energization of the coil 182, closes the normally open contacts 182*a* and opens the normally closed contacts 182*b*. This provides the current path 188 through the field 174 to operate the motor 36 in such a way as to rotate the main shaft 40 in a clockwise direction. Clockwise rotation of the main shaft 40 rotates the drive lever 68 clockwise to charge the spring 26, the output lever 52 being held by the roller 110. It should be pointed out that, at this time ($T_7$) the contacts 152*a* have been opened because latch member 112 has been removed from the notch 78 by the kicker 124. Energization of the coil 182 at this time is not affected by any of the other branches 192,194,196 inasmuch as at least one contact pair in each other branch is open at this time. Specifically, contacts 154*b* are open because the output lever 52 is fully counterclockwise; also, the contacts 144*b* are open because the drive lever 68 is fully counterclockwise. The contacts 138*b* are open because the roller 108 is not within the notch 60. Lastly, the contacts 140*b* are open because the roller 110 is in the notch 60. Thus, the motor 36 begins operation to recharge the spring 26 for an opening operation of the switch 14**.

The contacts **144*b* close shortly after this recharing operation is begun (time $T_8$). Closure of these contacts 144*b*, however, does not affect the energized state of the coil 182 and the de-energized state of the coil 184. A short time later (time $T_9$), the contacts 142*a* open, since these contacts open when the drive lever 68 is about 10 to 20 degrees away from its full clockwise position. Again, however, opening of the contacts 142*a* has no effect on the state of either coil 182 or 184. Subsequently, the contacts 150*a* open (time $T_{10}$) as the latch member 114 enters the notch 78. This full clockwise rotation of the drive lever 68 with the output lever 52 held, recharges the spring 26 to re-open the switch 14 at a later time (right-hand dotted lines between times $T_{10}$ and $T_{11}$ in FIG. 11). If the solenoid 134 is now operated (time $T_{11}$), the output lever 52 is freed to rotate clockwise under the influence of the charged spring 26 to open the switch 14. Specifically, energization of the solenoid 134 removes the roller 110 from the notch 60 freeing the output lever 52 for clockwise rotation. The operation of the solenoid 134 opens the formerly closed contacts 140*a* and closes the formerly open contacts 140*b*. Neither of these contact operation affect the de-energized state of both coils 182 and 184. As the output lever 52 rotates to open the switch 14, the contacts 154*b* close and the contacts 154*a* open when the output lever 52 is about 10 to 20 degrees away from its full clockwise position (time $T_{12}$). This has the affect of energizing the anti-bounce branch 192 associated with the coil 182. Specifically, as already stated, the contacts 154*b* are closed when the output lever 52 is about 10 to 20 degrees away from its full clockwise position. The contacts 138*a* are closed because the roller 108 is not within the notch 60. Lastly, the contacts 144*b* are closed because the drive lever 68 is in its full clockwise position. If the roller 108 enters the notch 60 at the end of the full clockwise movement of the output lever 52, the contacts 138*a* open, deenergizing the anti-bounce branch 192 and the coil 182. Should the roller 108 fail to enter the notch 60 for any reason, or bounce out thereof because of the high energy and speeds involved in operation of the operator 20, the anti-bounce branch 192 remains energized as does the coil 182 and the motor 36. Such energization of the motor 36 effects clockwise rotation of the main shaft 40 and of the drive lever 68 to charge the spring 26 in a clockwise direction, holding the output lever 52 in a position where the notch 60 can ultimately receive the roller 108. Again, the failure of the roller 108 to immediately enter the notch 60 may be due to the high impact forces involved which bounce the roller out of the notch, or merely to the inertia of the roller 108, the solenoid 130 and the other mechanical elements of the switch operator 20. Once the roller 108 enters the notch 60, the initial state of affairs obtains (FIG. 3) wherein the contacts 138*a* are open and the contacts 138*b* are closed (time $T_{13}$ is the same as $T_1$). That is, because the contacts 152*a* are closed due to the latch 112 having been removed from the notch 78, the coil 184 is energized to operate the motor 36 to charge the spring 26** in a counterclockwise direction for a subsequent switch closing operation.

It should be noted that both anti-bounce branches 192 and 196 energize the respective coils 182 and 184 at a point in time when the output lever 52 is about 10 to 20 degrees from its full rotation as determined by the stops 84 and 86. The pickup of the contacts **182*a,b* and 184*a,b* is approximately 20 milliseconds, which is substantially greater than the time it takes the output lever 52 to rotate this last 10 to 20 degrees. Accordingly, if the rollers 108 or 110 do enter the notch 60 in an appropriate fashion, the anti-bounce branches 192 and 196 are opened before the contacts 182*a,b* and 184*a,b* have been picked up. This momentary energization of the coils 182 and 184 has no effect on the operation of the output lever 52. It is only in the event that the rollers 108 and 110 fail to enter the notch 60 as appropriate that the anti-bounce branches 192 and 196 remain complete to energize the coils 182 or 184, thus holding the output lever 52 in a position wherein the rollers 108 and 110 may enter the notch 60**.

What is claimed is:

1. An improved switch operator of the type having (a) a first movable member; (b) a second movable member connectable to the switch for operation thereof; (c) means connected between the members for storing energy which biases the second member for movement in a first direction to a first position following movement of the first member in the first direction while a selectively releasable first latch holds the second member in a second position, and for storing energy which biases the second member for movement in a second direction to the second position while a selectively releasable second latch holds the second member in the first position; (d) a third latch for holding the first member after a predetermined amount of movement thereof in the first direction; (e) a fourth latch for holding the first member after a predetermined amount of movement thereof in the second direction; (f) first disengaging means for disengaging the third latch in response to movement of the second member to the first position to free the first member for movement in the second direction; (g) second disengaging means for disengaging the fourth latch in response to movement of the second member to the second position to free the first member for movement in the first direction; and (h) selectively energizable means for moving the first member; wherein the improvement comprises:

first sensing means (i) for energizing the moving means to move the first member in the first direction in response to the holding of the second member by the first latch, and (ii) for de-energizing the moving means in response to the third latch holding the first member;

second sensing means (i) for energizing the moving means to move the first member in the first direction in response both to movement of the second member to the first position following release of the first latch and to the second member not being held by the second latch, so that the energy storing means maintains the second member in the first position until the second latch holds the second member, and (ii) for de-energizing the moving means in response to the second latch holding the second member;

third sensing means (i) for energizing the moving means to move the first member in the second direction in response to the holding of the second member by the second latch, and (ii) for de-energizing the moving means in response to the fourth latch holding the first member; and fourth sensing means (i) for energizing the moving means to move the first member in the second direction in response both to movement of the second member to the second position following release of the second latch and to the second member not being held by the first latch so that the energy storing means maintains the second member in the second position until the first latch holds the second member, and (ii) for de-energizing the moving means in response to the first latch holding the first member.

2. The switch operator of claim 1, wherein the first sensing means energizes the moving means to move the first member in the first direction in response to both (i) the holding of the second member by the first latch, and (ii) the third latch not holding the first member; and the third sensing means energizes the moving means to move the first member in the second direction in response to both (i) the holding of the second member by the second latch, and (ii) the fourth latch not holding the first member.

3. The switch operator of claim 2, wherein the second sensing means energizes the moving means in response to also the first member having begun to move in the first direction; and the fourth sensing means energizes the moving means in response to also the first member having begun to move in the second direction.

4. An improved switch operator of the type having (a) an output member connectable to the switch, the output member being movable in a first direction to a first position from a second position to operate the switch, and being movable in a second direction to the second position from the first position to operate the switch in an opposite sense; (b) stored energy means for moving the output member in the first and second directions by the discharge thereof, the stored energy means being chargeable, when the output member is held in the second position, for subsequent discharge to move the output member in the first direction and being chargeable, when the output member is held in the first position, for subsequent discharge to move the output member in the second direction; and (c) selectively energizable means for charging the stored energy means; wherein the improvement comprises:

first means responsive to failure of the output member to be held in the first position following its movement in the first direction by the discharge of the stored energy means for energizing the charging means, thereby recharging the stored energy means to move the output member in the first direction and to maintain the output member in the first position until it is held thereat; and second means responsive to failure of the output member to be held in the second position following its movement in the second direction by the discharge of the stored energy means for energizing the charging means, thereby re-charging the stored energy means to move the output member in the second direction and to maintain the output member in the second position until it is held thereat.

5. The switch operator of claim 4, wherein the first and second means energize the charging means prior to the output member reaching the first and second positions, respectively.

6. The switch operator of claim 5, wherein the first and second means de-energize the charging means in response to the output member being held at the first and second positions, respectively.

7. The switch operator of claim 6, which further comprises third means responsive to the output member being held at the first position and to the stored energy means having been discharged for energizing the charging means to charge the stored energy means for subsequent discharge to move the output member in the second direction, and fourth means responsive to the output member being held at the second position and to the stored energy means having been discharged for energizing the charging means to charge the stored energy means for subsequent discharge to move the output member in the first direction.

8. The switch operator of claim 7, of the type further having a drive member (a) movable by the charging means in the first direction to charge the stored energy means for a subsequent discharge which moves the output member in the first direction, and (b) movable by the charging means in the second direction to charge the stored energy means for a subsequent discharge which moves the output member in the second direction, wherein the improvement further comprises:

fifth means responsive to sufficient movement of the drive member in the first direction to charge the stored energy means for de-energizing the charging means after its energization by the fourth means, and sixth means responsive to sufficient movement of the drive member in the second direction to charge the stored energy means for de-energizing the charging means after its energization by the third means.

* * * * *